US010914020B2

(12) United States Patent
Chang et al.

(10) Patent No.: US 10,914,020 B2
(45) Date of Patent: Feb. 9, 2021

(54) WAVE ABSORBING MEMBER ATTACHABLE TO PADDLE AND PLATING APPARATUS INCLUDING WAVE ABSORBING MEMBER

(71) Applicant: EBARA CORPORATION, Tokyo (JP)

(72) Inventors: Shao Hua Chang, Tokyo (JP); Jumpei Fujikata, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 35 days.

(21) Appl. No.: 16/216,852

(22) Filed: Dec. 11, 2018

(65) Prior Publication Data

US 2019/0186038 A1 Jun. 20, 2019

(30) Foreign Application Priority Data

Dec. 15, 2017 (JP) ..... 2017-240776

(51) Int. Cl.

| | |
|---|---|
| ***C25D 5/08*** | (2006.01) |
| ***C25D 21/10*** | (2006.01) |
| ***C25D 17/02*** | (2006.01) |
| ***B01F 7/00*** | (2006.01) |
| ***C25D 17/00*** | (2006.01) |

(52) U.S. Cl.

CPC ..... *C25D 21/10* (2013.01); *B01F 7/006* (2013.01); *B01F 7/0025* (2013.01); *C25D 17/001* (2013.01); *C25D 17/02* (2013.01); *B01F 2215/0096* (2013.01); *C25D 17/008* (2013.01)

(58) Field of Classification Search

CPC ..... C25D 21/10; C25D 17/001; C25D 5/08; C25D 17/00; C25D 5/20; C25D 17/02

USPC ..... 204/273

See application file for complete search history.

(56) References Cited

U.S. PATENT DOCUMENTS

RE45,687 E 9/2015 Saito et al.
2005/0006241 A1* 1/2005 McHugh ..... C25D 17/008 205/80

FOREIGN PATENT DOCUMENTS

JP 2009-155726 A 7/2009

* cited by examiner

*Primary Examiner* — Zulmariam Mendez
(74) *Attorney, Agent, or Firm* — BakerHostetler

(57) ABSTRACT

To prevent turbulence on a surface of a plating solution as much as possible and suppress spattering and splashing of the plating solution even when the plating solution is stirred. Provided is a wave absorbing member that is attachable to a paddle moveable in a horizontal direction to stir liquid. The wave absorbing member includes a thin plate shaped body portion configured to move on a liquid surface when moving in the horizontal direction and a front end portion designed to be tapered toward an end from the body portion.

9 Claims, 12 Drawing Sheets

WAVE ABSORBING MEMBER ATTACHABLE TO PADDLE AND PLATING APPARATUS INCLUDING WAVE ABSORBING MEMBER

CROSS-REFERENCE TO RELATED APPLICATION

This application is based upon and claims the benefit of priority of the prior Japanese Patent Application No. 2017-240776, filed on Dec. 15, 2017, the entire contents of which are incorporated herein by reference.

TECHNICAL FIELD

The present application relates to a wave absorbing member attachable to a paddle and a plating apparatus including the wave absorbing member.

BACKGROUND

In the manufacture of semiconductor devices, electroplating may be used. A high-purity metal film (plated film) can be obtained with ease by electroplating. Further, electroplating can not only form a metal film at a relatively high rate, but can also control a thickness of the metal film relatively easily. In the formation of a metal film on a semiconductor wafer, the in-plane uniformity of a thickness of the metal film is required in order to attain high-density packaging, high performance, and high yield. When electroplating is used to form a metal film, the distribution of metal ion feed rate and the distribution of electric potential in a plating solution can be made uniform. It is therefore expected that electroplating will be capable of obtaining a metal film excellent in the in-plane uniformity of a thickness of the metal film. In electroplating, the plating solution may be stirred in order to uniformly supply a sufficient amount of ions to a substrate. A plating apparatus including a stirring paddle in order to stir the plating solution is known (PTL 1).

CITATION LIST

Patent Literature

PTL 1: Japanese Patent Laid-Open No. 2009-155726

SUMMARY

When a plating solution is stirred, the plating solution may be spattered and may scatter outside the plating tank, or may cause splashing, which results in precipitating components contained in the plating solution and consequently dirtying the apparatus. Moving a paddle for stirring the plating solution at a higher velocity is especially effective for uniformity of ions in the plating solution. Moving the paddle at a high velocity easily causes turbulence on the surface of the plating solution and splashing. Therefore, an object of the present invention is to prevent turbulence on the surface of the plating solution as much as possible and suppress spattering and splashing of the plating solution even when the plating solution is stirred. Further, the present invention is widely applicable for stirring liquid in addition to the plating apparatus.

[Embodiment 1] According to Embodiment 1, provided is a wave absorbing member that is attachable to a paddle moveable in a horizontal direction to stir liquid, the wave absorbing member including: a thin plate shaped body portion configured to move on a liquid surface when moving in the horizontal direction; and a front end portion designed to be tapered toward an end from the body portion.

[Embodiment 2] According to Embodiment 2, in the wave absorbing member according to Embodiment 1, the front end portion is inclined at an acute angle with respect to the horizontal plane with the wave absorbing member being attached to the paddle.

[Embodiment 3] According to Embodiment 3, the wave absorbing member according to Embodiment 1 or 2, further includes a guide portion that is formed on both sides of the thin plate shaped body portion and extends in the horizontal direction as a whole.

[Embodiment 4] According to Embodiment 4, in the wave absorbing member according to Embodiment 3, the guide portion includes a linear portion.

[Embodiment 5] According to Embodiment 5, in the wave absorbing member according to Embodiment 3 or 4, the guide portion includes a curved portion.

[Embodiment 6] According to Embodiment 6, in the wave absorbing member according to any one of Embodiments 3 to 5, the guide portion includes a first portion extending upward from the liquid surface and a second portion extending downward to the liquid surface.

[Embodiment 7] According to Embodiment 7, in the wave absorbing member according to any one of Embodiments 3 to 6, a plurality of the guide portions is provided.

[Embodiment 8] According to Embodiment 8, a paddle that is moveable in a horizontal direction to stir liquid includes the wave absorbing member according to any one of Embodiments 1 to 7.

[Embodiment 9] According to Embodiment 9, a plating apparatus includes: a plating tank that stores a plating solution; and the paddle according to Embodiment 8 configured to stir the plating solution stored in the plating tank.

DETAILED DESCRIPTION

Hereinafter, exemplary embodiments of a wave absorbing member attachable to a paddle and a plating apparatus including the wave absorbing member according to the present invention will be explained along with accompanying drawings. In the accompanying drawings, the same or similar reference numbers are attached to the same or similar components, and redundant explanation for the same or similar components may be omitted in the explanation of each embodiment. In addition, features shown in each embodiment can be applied to other embodiments, unless they conflict with each other.

Figure 1:
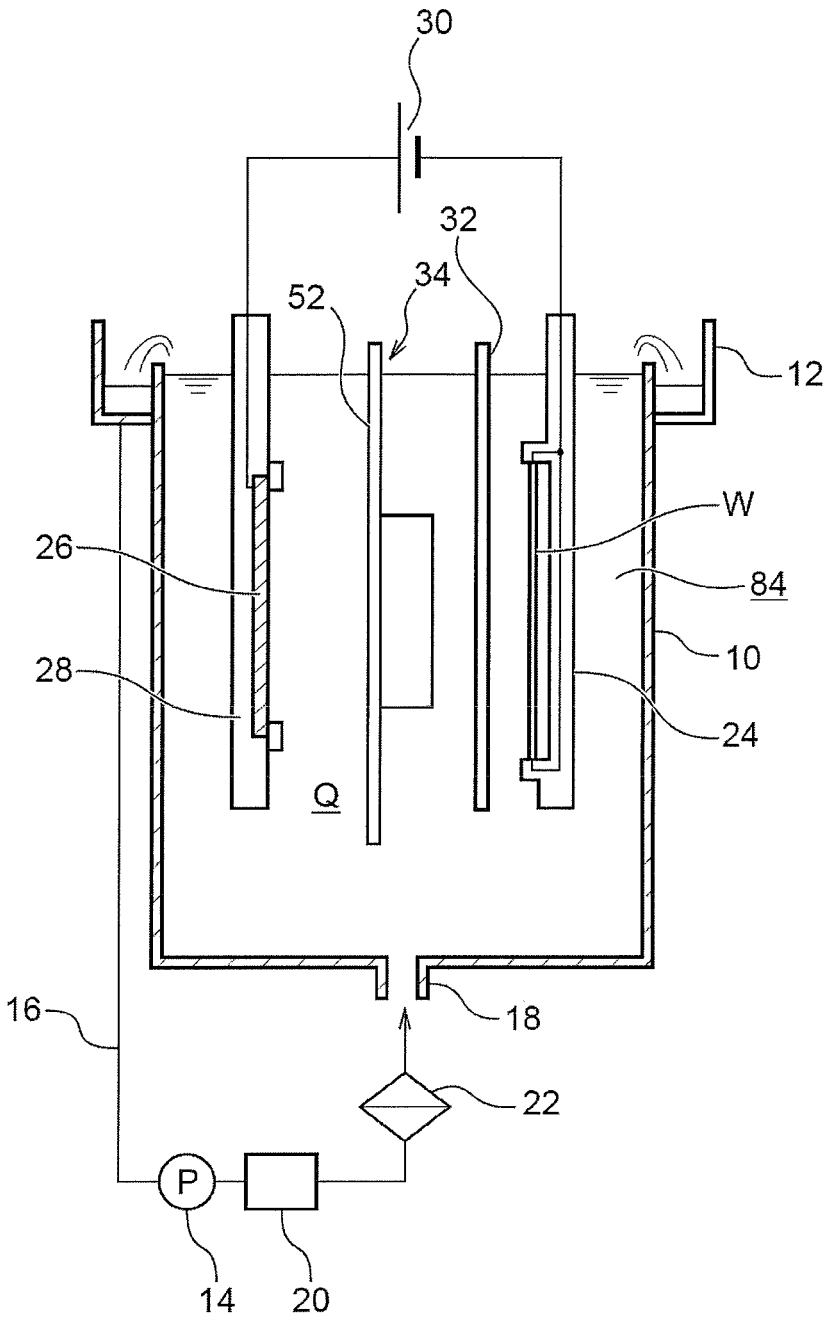
FIG. 1 is a diagram schematically illustrating a plating apparatus according to an embodiment.

FIG. 1 is a diagram schematically illustrating a plating apparatus according to an embodiment. The plating apparatus can be, for example, a plating apparatus for carrying out copper plating on a surface of a semiconductor substrate using a plating solution Q containing copper sulfate. As shown in FIG. 1, the plating apparatus includes a plating tank 10 holding the plating solution Q therein. An overflow tank 12 for receiving the plating solution Q that has overflowed an edge of the plating tank 10 is provided around an upper end of the plating tank 10. One end of a plating solution supply route 16, which is provided with a pump 14, is connected to a bottom of the overflow tank 12, and the other end of the plating solution supply route 16 is connected to a plating solution supply inlet 18 provided at a bottom of the plating tank 10. Thereby, the plating solution Q in the overflow tank 12 is returned into the plating tank 10 by the actuation of the pump 14. Located downstream of the pump 14, a constant-temperature unit 20 for controlling the temperature of the plating solution Q and a filter 22 for filtering out foreign matter contained in the plating solution are provided in the plating solution supply route 16.

The plating apparatus also includes a substrate holder 24 for detachably holding a substrate (plating object) W and immersing the substrate W in a vertical position in the plating solution Q in the plating tank 10. An anode 26, held by an anode holder 28 and immersed in the plating solution Q in the plating tank 10, is disposed opposite the substrate W held by the substrate holder 24 and immersed in the plating solution Q. In this example, phosphorus-containing copper is used for the anode 26. The substrate W and the anode 26 are electrically connected via a plating power source 30, and a plated film (copper film) is formed on the surface of the substrate W by passing electric current between the substrate W and the anode 26.

A paddle 32, which reciprocates parallel to the surface of the substrate W to stir the plating solution Q, is disposed between the substrate W, which is held by the substrate holder 24 and immersed in the plating solution Q, and the anode 26. By stirring the plating solution Q with the paddle 32, a sufficient amount of copper ions can be supplied uniformly to the surface of the substrate W. The distance between the paddle 32 and the substrate W is preferably 2 mm to 11 mm. Further, a regulation plate 34 of dielectric material, for making the distribution of electric potential more uniform over the entire surface of the substrate W, is disposed between the paddle 32 and the anode 26.

Figure 2:
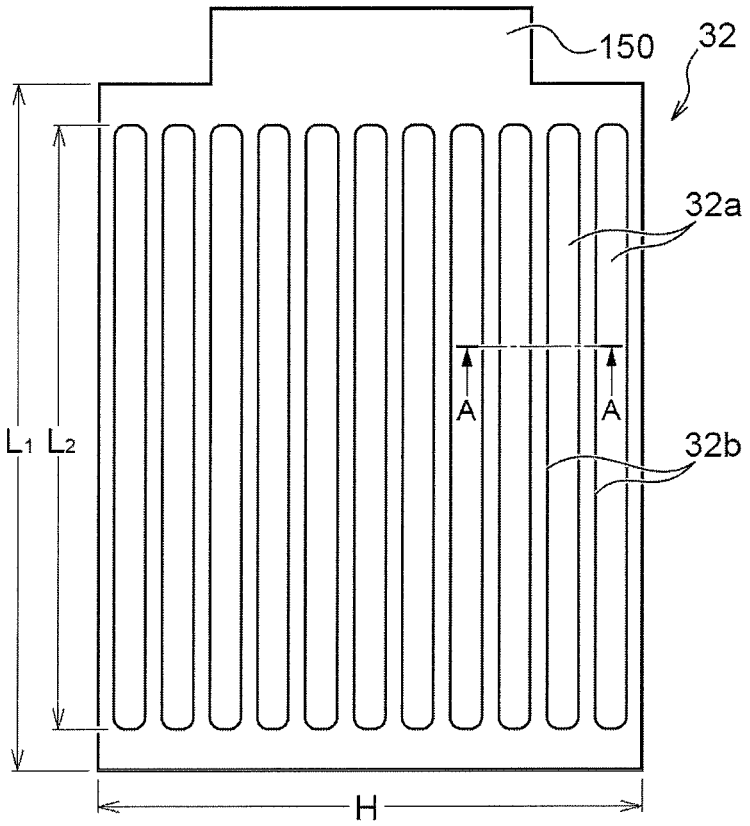
FIG. 2 is a diagram illustrating a paddle shown in FIG. 1 when viewed from the front (the lateral direction in FIG. 1)
Figure 3:
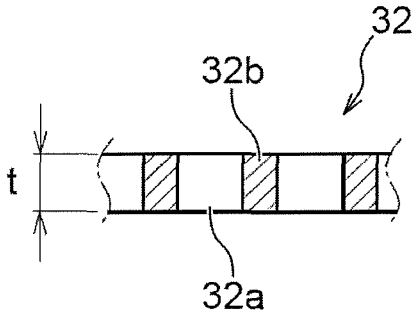
FIG. 3 is a partial sectional view of the paddle shown in FIGS. 1 and 2 when viewed from the top (above in FIGS. 1 and 2)

FIG. 2 is a diagram illustrating the paddle 32 shown in FIG. 1 when viewed from the front (the lateral direction in FIG. 1). FIG. 3 is a partial sectional view of the paddle 32 shown in FIGS. 1 and 2 when viewed from the top (above in FIGS. 1 and 2). As shown in FIGS. 2 and 3, the paddle 32 is comprised of a rectangular plate-like member having a uniform thickness t of 3 mm to 6 mm. The paddle 32 is provided with a plurality of parallel slits 32*a* inside to have a plurality of vertically-extending strip-shaped portions 32*b*. The paddle 32 is formed of, for example, titanium with a Teflon (registered trademark) coating. The vertical length L1 of the paddle 32 and the vertical length L2 of the slits 32*a* are sufficiently larger than the vertical size of the substrate W. Further, the paddle 32 is designed so that the sum of its lateral length H and its reciprocation distance (stroke St) is sufficiently larger than the lateral size of the substrate W.

It is preferred that the width and the number of the slits 32*a* be determined such that each strip-shaped portion 32*b* is as narrow as possible insofar as it has the necessary rigidity so that the strip-shaped portions 32*b* between the slits 32*a* can efficiently stir the plating solution and, in addition, the plating solution can efficiently pass through the slits 32*a*. Narrowing the strip-shaped portions 32*b* of the paddle 32 is important also in order to reduce the formation of a shadow of electric field (a spot not or little affected by electric field) on the substrate W when the paddle 32 slows down near the stroke ends of its reciprocation or makes a momentary stop.

Figure 4A:
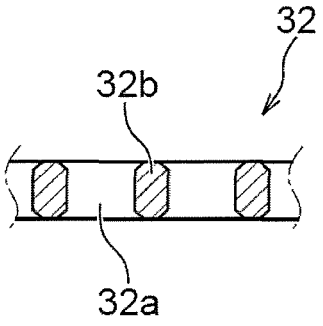
FIGS. 4(A) and (B) are partial sectional views of the paddle shown in FIGS. 1 and 2 when viewed from the top (above in FIGS. 1 and 2)
Figure 4B:
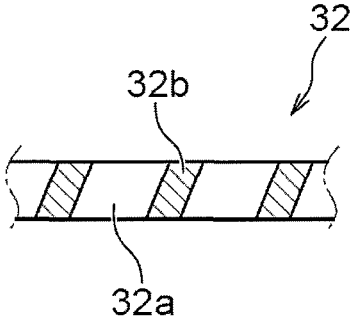

In this example, as shown in FIG. 3, the slits 32*a* are formed vertically such that each strip-shaped portion 32*b* has a rectangular cross section. As shown in FIG. 4(A), each strip-shaped portion 32*b* may be chamfered at the four corners in its cross section, or alternatively, as shown in FIG. 4(B), each strip-shaped portion 32*b* may be inclined so that it has a parallelogram cross-sectional shape.

The thickness (plate thickness) t of the paddle 32 is preferably 3 mm to 6 mm, and is 4 mm in this example, in order that the regulation plate 34 can be disposed near the substrate W. By making the thickness of the paddle 32 uniform, spattering or large waving of the plating solution can be prevented. In addition, a neck portion 150 having a relatively small lateral size is provided above a region where the slits 32*a* are formed in the paddle 32. Clamps 36 are fixed to the neck portion 150 as described below. Further, wave absorbing members 200 are arranged at respective ends of the neck portion 150 as described below (see FIG. 5).

Figure 5:
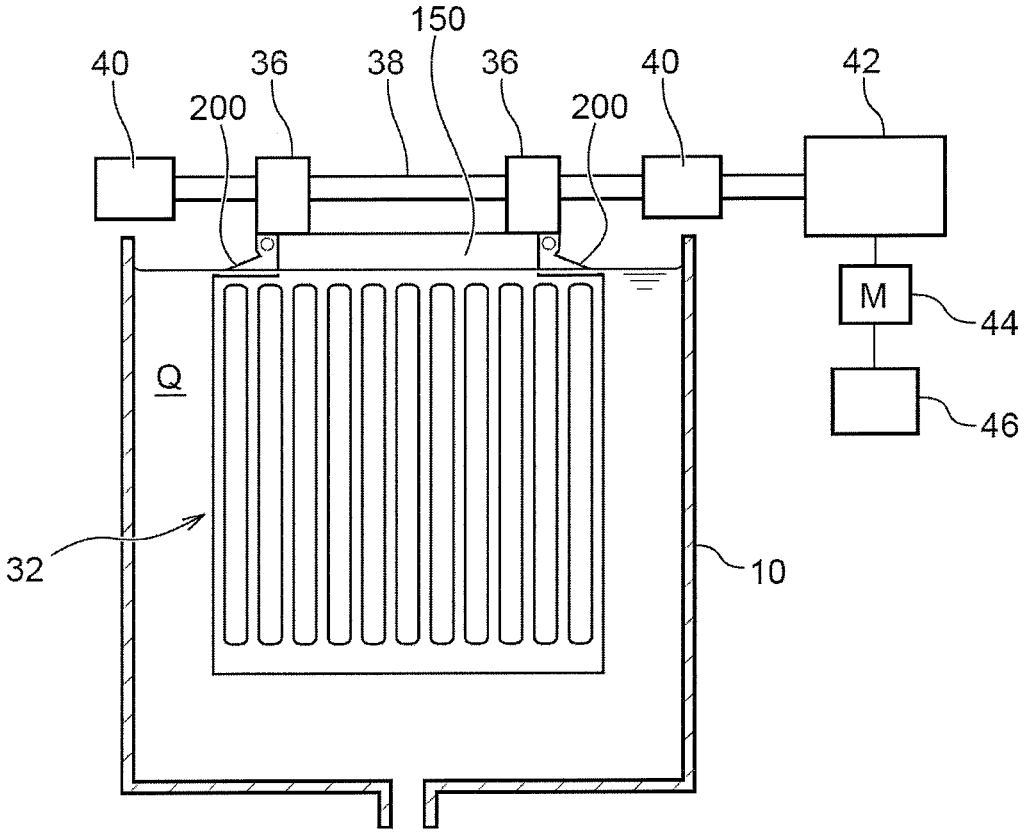
FIG. 5 is a diagram illustrating a paddle drive mechanism according to an embodiment together with a plating tank.

FIG. 5 is a diagram illustrating a drive mechanism of the paddle 32 together with the plating tank 10. The paddle 32 is secured to a horizontally-extending shaft 38 by the clamps 36 fixed to the upper end of the paddle 32. The wave absorbing members 200 described below are attached to the clamps 36, and the wave absorbing members 200 are arranged at the respective ends of the neck portion 150 of the paddle 32. The shaft 38 is held by shaft holders 40 and can slide horizontally. The end of the shaft 38 is coupled to a paddle drive section 42 for reciprocating the paddle 32 linearly and horizontally. The paddle drive section 42 converts the rotation of a motor 44 into the linear reciprocating movement of the shaft 38 by, for example, a crank mechanism (not shown). In this example, a control section 46, which controls the movement velocity of the paddle 32 by controlling the rotational speed of the motor 44 of the paddle drive section 42, is provided. The reciprocation speed of the paddle is arbitrarily set but may be about 250 reciprocation/min to about 400 reciprocation/min, for example. Instead of the paddle drive section which uses the crank mechanism, it is also possible to use a paddle drive section which converts the rotation of a servo motor into the linear reciprocating movement of a shaft by means of a ball screw, or a paddle drive section which linearly reciprocates a shaft by means of a linear motor.

Figure 6:
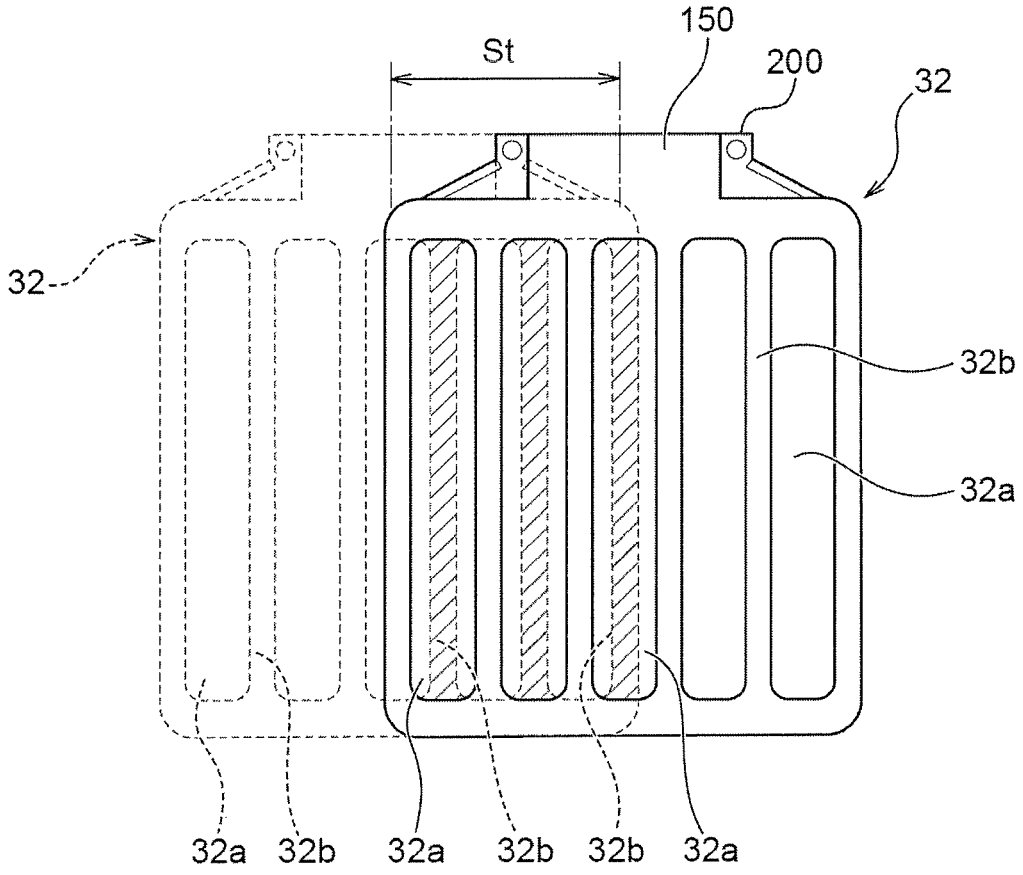
FIG. 6 is a plan view illustrating a relationship of the paddle at the stroke end of the paddle.

In this example, as shown in FIG. 6, the paddle 32 is reciprocated with such a stroke St that the strip-shaped portions 32*b* of the paddle 32 positioned at one stroke end do not overlap the strip-shaped portions 32*b* of the paddle 32 positioned at the other stroke end. This can reduce the influence of the paddle 32 on the formation of a shadow of electric field on the substrate W.

In an embodiment, the plating apparatus includes wave absorbing members 200 attachable to the paddle 32. As shown in FIG. 5, the wave absorbing members 200 are arranged to be located on the liquid surface of the plating solution Q when the paddle 32 is disposed in the plating tank 10 holding the plating solution Q. As shown in FIG. 5, the wave absorbing members 200 can operate integrally with the paddle 32 by being attached to the clamps 36. Alternatively, the wave absorbing members 200 may be directly fixed to the paddle 32 without involving the clamps 36.

Figure 7A:
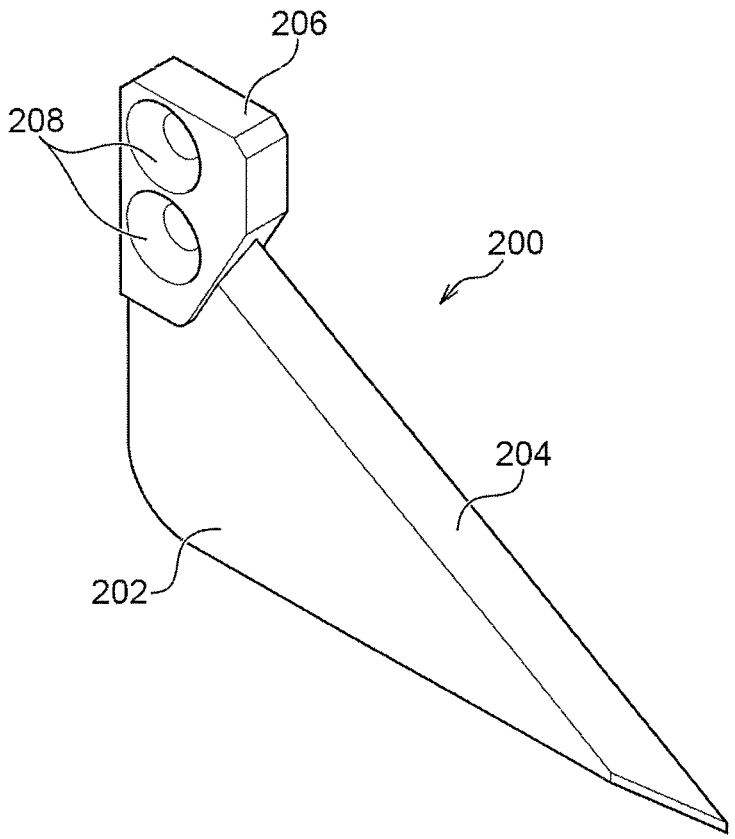
FIG. 7A is a perspective view of a wave absorbing member according to an embodiment.
Figure 7B:
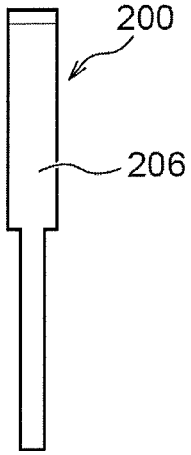
FIG. 7B is a left side view of the wave absorbing member shown in FIG. 7A.
Figure 7C:
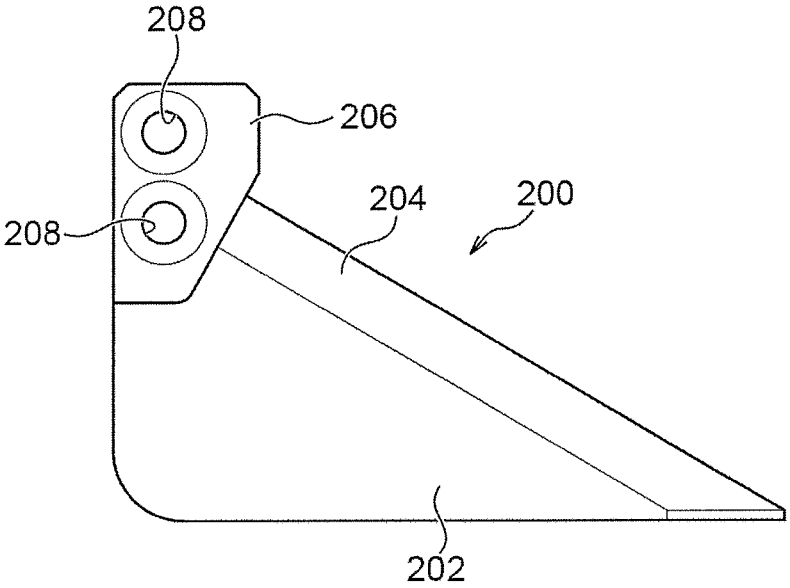
FIG. 7C is a front view of the wave absorbing member shown in FIG. 7A.
Figure 7D:
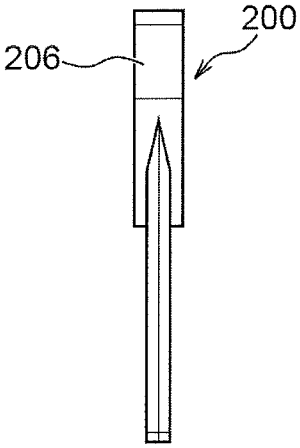
FIG. 7D is a right side view of the wave absorbing member shown in FIG. 7A.

FIG. 7A is a perspective view of a wave absorbing member 200 according to an embodiment, FIG. 7B is a left side view of the wave absorbing member 200 shown in FIG. 7A, FIG. 7C is a front view of the wave absorbing member 200 shown in FIG. 7A, and FIG. 7D is a right side view of the wave absorbing member 200 shown in FIG. 7A. The wave absorbing member 200 is formed of a substantially right-angled triangular thin plate, as a whole. The wave absorbing member 200 includes a substantially right-angled triangular body portion 202. Also, the wave absorbing member 200 includes a front end portion 204 which is tapered toward an end (left side of FIG. 7C) from the body portion 202. The front end portion 204 is formed in the position that corresponds to the hypotenuse of the right-angled triangular body portion 202. The front end portion 204 is inclined at an acute angle with respect to the horizontal plane with the wave absorbing members 200 being attached to the paddle 32. An angle between the front end portion 204 and the horizontal plane may be an arbitrary angle and, for example, is preferably in a range of 20 to 45 degrees, and the angle may be 30 degrees by way of example. Alternatively, as an embodiment, the angle between the front end portion 204 and the horizontal plane may be 90 degrees, that is, a front end portion that is not inclined may be employed. Further, the front end portion 204 is designed to travel by cutting the liquid surface of the plating solution Q with its tapered front edge when the wave absorbing member 200 is attached to the paddle 32 and moved in the horizontal direction to stir the plating solution Q. An angle with its vertex being on the hypotenuse when the front end portion 204 is cut across a cross section orthogonal to the hypotenuse of the front end portion 204 can be in a range of 10 to 30 degrees. The wave absorbing member 200 includes an attachment portion 206 for attaching the wave absorbing member 200 to the paddle 32. The attachment portion 206 has holes 208 for passing screws for fixing the wave absorbing member 200 to the clamp 36. Although in the illustrated embodiment, two holes 208 are provided in order to prevent the wave absorbing member 200 from rotating, the number of the holes 208 is arbitrary and may be one or be three or more. The wave absorbing member 200 illustrated in FIGS. 7A to 7D has a thickness equivalent to that of the paddle 32 and the thickness t. Note that the illustrated wave absorbing member 200 is designed so that the attachment portion 206 is thicker than the body portion 202. For example, the thicknesses of the attachment portion 206 and the paddle 32 may be made the same, and the body portion 202 may be formed to be thinner than the attachment portion 206. As another embodiment, the thicknesses of the attachment portion 206 and the body portion 202 of the wave absorbing member 200 may be the same. The wave absorbing member 200 is formed of a material which is resistant to the liquid to be stirred. In an embodiment, the wave absorbing member 200 may be formed of polyvinyl chloride (PVC), polypropylene (PP), or the like, which is resistant to the plating solution Q for use, by injection molding or using a 3D printer.

In the illustrated embodiment, the plating solution Q is stirred by reciprocating the paddle 32 provided with the wave absorbing members 200 in the horizontal direction. The front end portion 204 of the wave absorbing member 200 is tapered, and thus it is possible to suppress generation of waves and droplets in the plating solution Q when the paddle 32 moves in the liquid surface.

Figure 8:
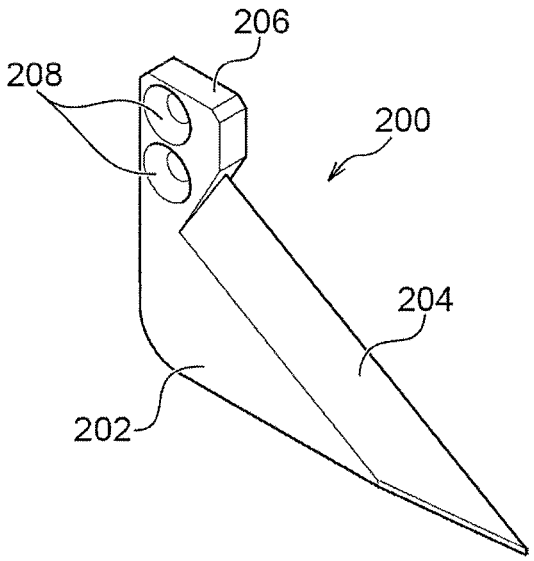
FIG. 8 is a perspective view of a wave absorbing member according to an embodiment.

FIG. 8 is a perspective view of a wave absorbing member 200 according to an embodiment. The wave absorbing member 200 of FIG. 8 is approximately the same as the wave absorbing member 200 of FIGS. 7A to 7D, but the wave absorbing member 200 of FIG. 8 is designed so that the attachment portion 206 and the body portion 202 have the same thickness. Apart from this, the wave absorbing member 200 of FIG. 8 may have optional features explained with reference to FIGS. 7A to 7D.

Figure 9:
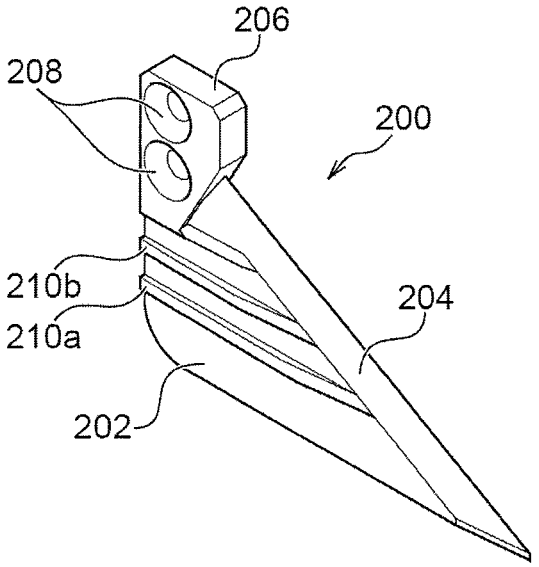
FIG. 9 is a perspective view of a wave absorbing member according to an embodiment.

FIG. 9 is a perspective view of a wave absorbing member 200 according to an embodiment. The wave absorbing member 200 of FIG. 9 has the overall shape similar to the wave absorbing member 200 of FIGS. 7A to 7D. However, the wave absorbing member 200 of FIG. 9 includes guide portions 210*a* and 210*b* formed on the body portion 202. The guide portions 210*a* and 210*b* each have a convex shape protruding from the body portion 202 in the thickness direction and extend linearly in the horizontal direction. In the illustrated embodiment, the guide portions 210*a* and 210*b* are provided on both sides of the thin plate shaped body portion 202. In the wave absorbing member 200 of FIG. 9, the guide portions 210*a* and 210*b* are provided only to the body portion 202 but not provided to the front end portion 204. Although in FIG. 9, two guide portions 210*a* and 210*b* are provided, an arbitrary number of guide portions may be provided. The guide portions 210*a* and 210*b* act to suppress the waves generated when the paddle 32 moves in the horizontal direction for stirring the plating solution Q. The wave absorbing member 200 according to the embodiment of FIG. 9 may employ the optional features of the wave absorbing member 200 explained with reference to FIGS. 7A to 7D.

Figure 10:
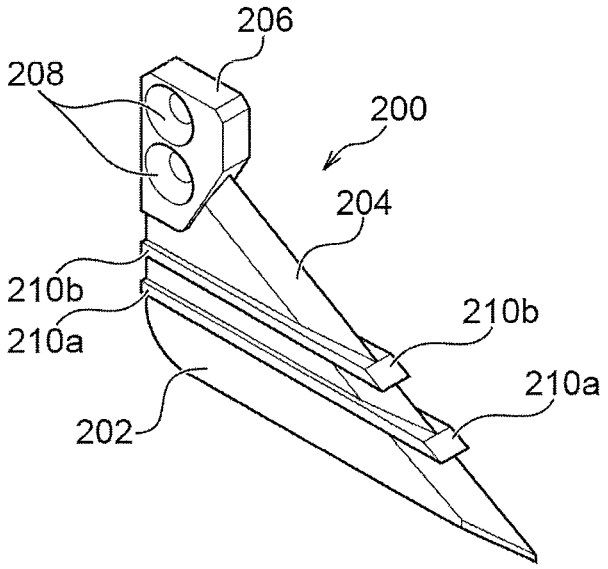
FIG. 10 is a perspective view of a wave absorbing member according to an embodiment.

FIG. 10 is a perspective view of a wave absorbing member 200 according to an embodiment. The wave absorbing member 200 illustrated in FIG. 10 has the shape similar to the wave absorbing member 200 illustrated in FIG. 9, but in the wave absorbing member 200 of FIG. 10, the guide portions 210*a* and 210*b* extend to the front end portion 204. The front ends of the guide portions 210*a* and 210*b* of FIG. 10 are inclined as with the slope of the front end portion 204. The wave absorbing member 200 according to the embodiment of FIG. 10 may employ the optional features of the wave absorbing member 200 explained with reference to FIGS. 7A to 7D.

Figure 11A:
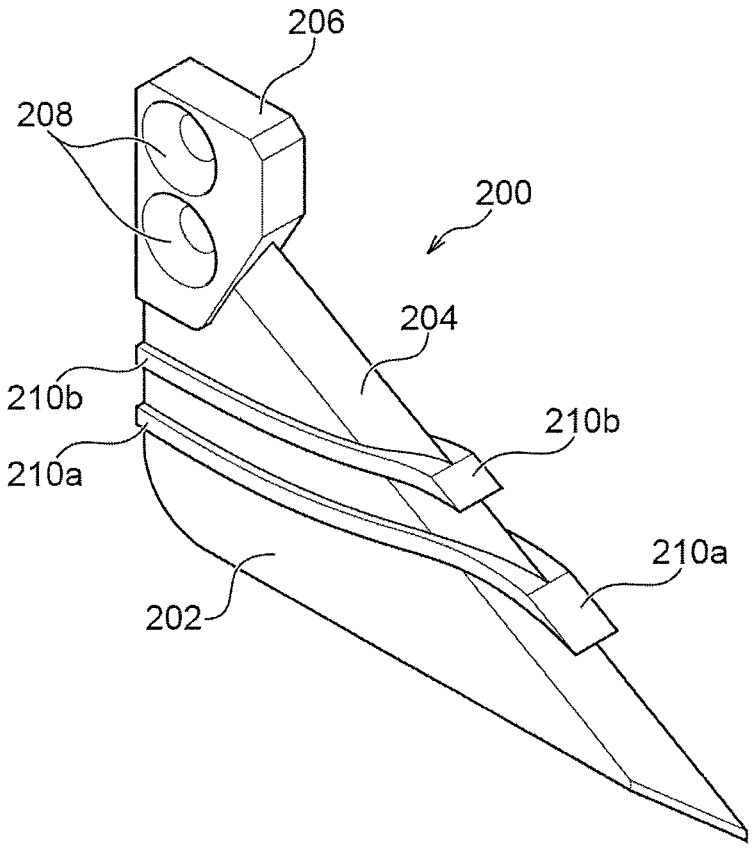
FIG. 11A is a perspective view of a wave absorbing member according to an embodiment.
Figure 11B:
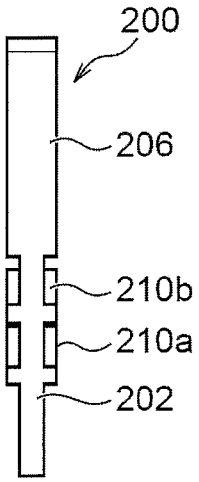
FIG. 11B is a left side view of the wave absorbing member shown in FIG. 11A.
Figure 11C:
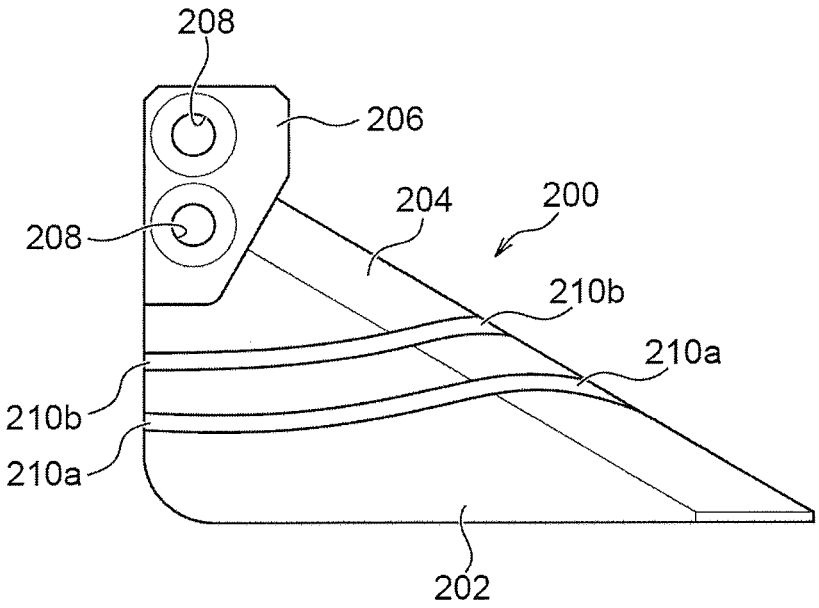
FIG. 11C is a front view of the wave absorbing member shown in FIG. 11A.
Figure 11D:
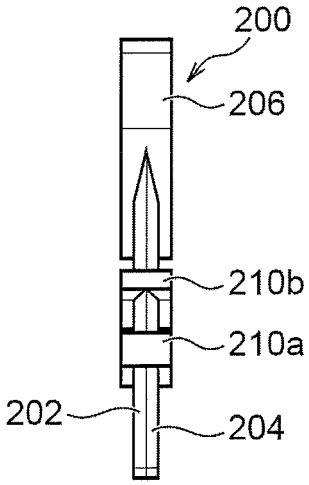
FIG. 11D is a right side view of the wave absorbing member shown in FIG. 11A.
Figure 12:
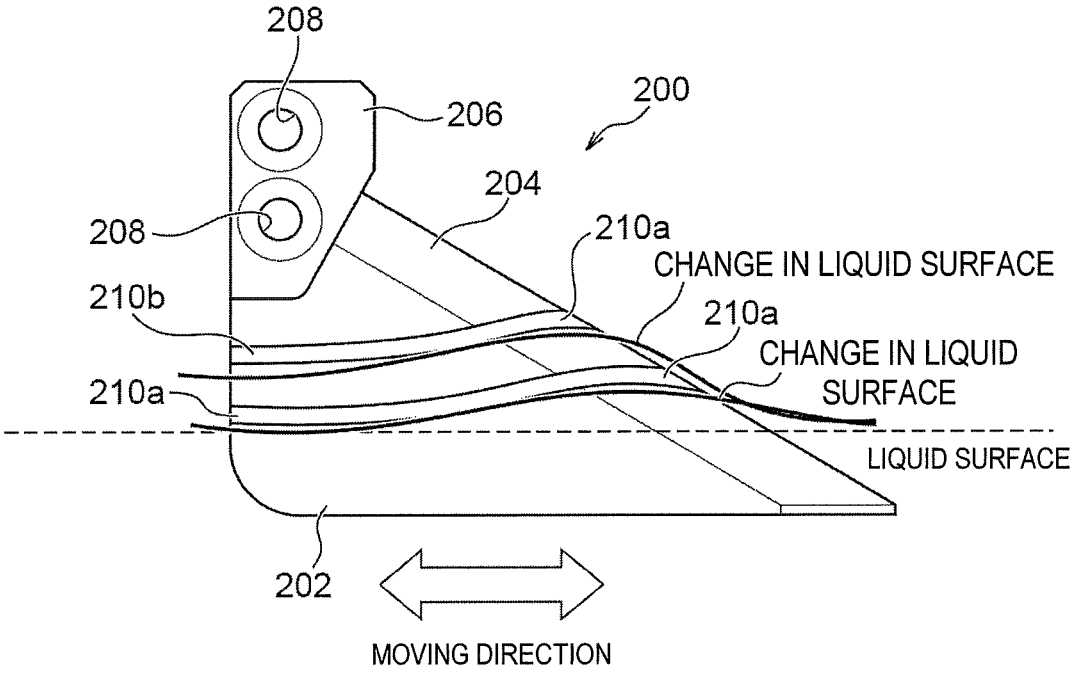
FIG. 12 illustrates action of the wave absorbing member shown in FIGS. 11A to 11D.

FIG. 11A is a perspective view of a wave absorbing member 200 according to an embodiment, FIG. 11B is a left side view of the wave absorbing member 200 shown in FIG. 11A, FIG. 11C is a front view of the wave absorbing member 200 shown in FIG. 11A, and FIG. 11D is a right side view of the wave absorbing member 200 shown in FIG. 11A. The wave absorbing member 200 illustrated in FIGS. 11A to 11D includes the guide portions 210*a* and 210*b* extending from the body portion 202 to the front end portion 204 as with the wave absorbing member 200 of FIG. 10. However, in the wave absorbing member 200 of FIGS. 11A to 11D, the guide portions 210*a* and 210*b* are provided not in a linear shape but in a streamlined shape. More specifically, each of the guide portions 210*a* and 210*b* of the wave absorbing member 200 illustrated in FIGS. 11A to 11D is formed to be lowest on a side of the neck portion 150 of the paddle 32 and to gradually extend upward, and then to extend approximately in the horizontal direction or downwardly. The guide portions 210*a* and 210*b* are provided such that the liquid surface of the plating solution Q substantially coincides with the lowest position of the guide portion 210*a*, in a state where the wave absorbing member 200 of FIGS. 11A to 11D is attached to the paddle 32 and immersed in the plating solution Q. FIG. 12 illustrates action of the wave absorbing member 200 illustrated in FIGS. 11A to 11D. As shown in FIG. 12, the liquid surface of the plating solution Q substantially coincides with the lowest position of the guide portion 210*a* on the lower side of the wave absorbing member 200. In this state, the paddle 32 moves in the horizontal direction to stir the plating solution Q and the wave absorbing member 200 moves in the horizontal direction. In FIG. 12, the wave absorbing member 200 moves laterally. When the wave absorbing member 200 moves to the right, the plating solution Q rises along the slope of the front end portion 204 of the wave absorbing member 200. At this time, the plating solution Q is guided in a direction opposite the direction of travel of the wave absorbing member 200 by the guide portion 210*a* to the original liquid level, so that turbulence on the liquid surface is suppressed. The liquid surface that has risen over the lower guide portion 210*a* is guided by the guide portion 210*b* toward the back surface of the wave absorbing member 200, so that turbulence on the liquid surface is suppressed.

As shown in FIG. 1, the substrate W is held by the substrate holder 24. The substrate holder 24 is designed to be capable of feeding electricity to a peripheral area of the substrate W having a surface conductive film, such as a sputtered copper film. The substrate holder 24 has multiple electrical contacts whose total width is not less than 60% of the circumferential length of the peripheral area of the substrate with which the electrical contacts can make contact. The electrical contacts are evenly distributed at equal intervals.

Figure 13:
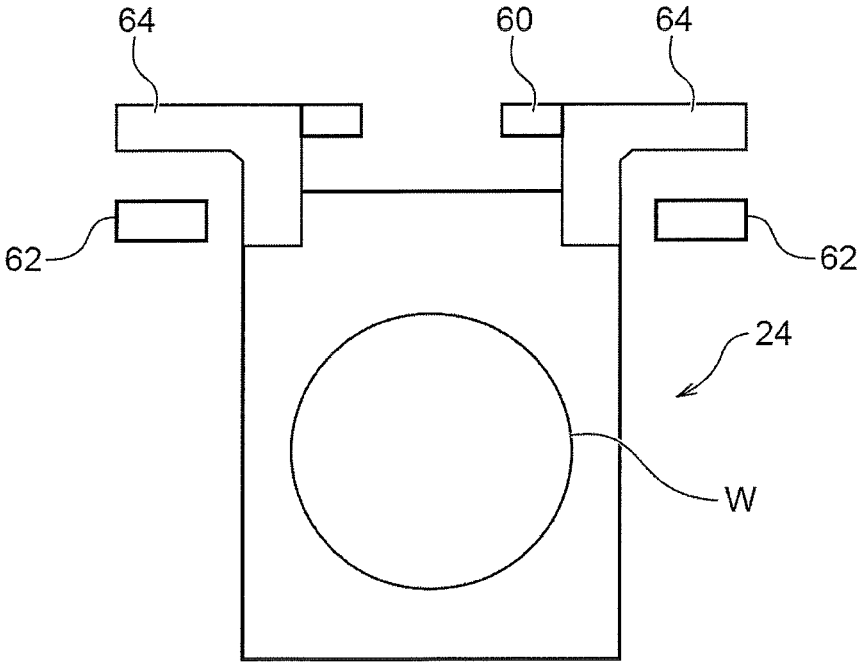
FIG. 13 is a diagram illustrating the relationship between a substrate holder of the plating apparatus shown in FIG. 1 and a holder support of the plating tank.

As shown in FIG. 13, the substrate holder 24, when it is set in the plating tank 10, is hung on a not-shown transporter with holder grips 60 gripped by the transporter, and then hung and held on holder supports 62, fixed on the plating tank 10, with outwardly-projecting holder arms 64 caught on the holder supports 62. When the substrate holder 24 is hung and supported on the plating tank 10, the arm-side contacts provided to the holder arms 64 and the support-side contacts provided to the holder supports 62 of the plating tank 10 come into contact with each other, thereby being capable of supplying an electric current to the substrate W from the external power source through the substrate holder 24.

Although an embodiment of the present invention has been described above based on specific examples, the embodiment described above is intended to facilitate understanding of the present invention and is not meant to limit the present invention. The present invention can be modified and improved without departing from the spirit of the present invention. Needless to say, the present invention includes equivalents thereof. Also, the components described in the appended claims and in the specification may be used in any combination or any of the components may be omitted as long as at least some of the problems described above can be solved or as long as at least some of the advantageous effects described above can be achieved. For example, the invention of the paddle and the wave absorbing member disclosed in the specification may be employed not only to stir the plating solution, but also to stir other liquids.

REFERENCE SIGNS LIST

10 plating tank
12 overflow tank
24 substrate holder
26 anode
28 anode holder
30 power source
32 paddle
32*a* slit
32*b* strip-shaped portion
34 regulation plate
36 clamp
38 shaft
40 shaft holder
42 paddle drive section
60 holder grip
62 holder support
64 holder arm
150 neck portion
200 wave absorbing member
202 body portion
204 front end portion
206 attachment portion
208 hole
210*a* guide portion
210*b* guide portion
W substrate

What is claimed is:

1. A wave absorbing member that is attachable to a paddle moveable in a horizontal direction to stir liquid, the wave absorbing member comprising:

a thin plate shaped body portion configured to move on a liquid surface when moving in the horizontal direction; and a front end portion designed to be tapered toward an end from the body portion wherein the tapered portion is configured to cut the liquid surface when moving in the horizontal direction, wherein the claimed front end portion is configured to cut the liquid surface when moving in the horizontal direction by providing a portion the front end portion above the liquid surface and a portion of the front end portion below the liquid surface.

2. The wave absorbing member according to claim 1, wherein the front end portion is inclined at an acute angle with respect to a horizontal plane with the wave absorbing member being attached to the paddle.

3. The wave absorbing member according to claim 1, further comprising a guide portion that is formed on both sides of the thin plate shaped body portion and extends in the horizontal direction as a whole.

4. The wave absorbing member according to claim 3, wherein the guide portion includes a linear portion.

5. The wave absorbing member according to claim 3, wherein the guide portion includes a curved portion.

6. The wave absorbing member according to claim 3, wherein the guide portion includes a first portion extending upward from the liquid surface and a second portion extending downward to the liquid surface.

7. The wave absorbing member according to claim 3, wherein a plurality of the guide portions is provided.

8. A paddle that is moveable in a horizontal direction to stir liquid, the paddle comprising the wave absorbing member according to claim 1.

9. A plating apparatus comprising:

a plating tank that stores a plating solution; and the paddle according to claim 8 configured to stir the plating solution stored in the plating tank.

* * * * *